US009272524B1

(12) United States Patent
Sugitani et al.

(10) Patent No.: US 9,272,524 B1
(45) Date of Patent: Mar. 1, 2016

(54) INK CIRCULATION TYPE INKJET PRINTER

(71) Applicant: RISO KAGAKU CORPORATION, Tokyo (JP)

(72) Inventors: Hiroshi Sugitani, Ibaraki (JP); Tomoyuki Akiyama, Ibaraki (JP); Isao Matsushima, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/851,163

(22) Filed: Sep. 11, 2015

(30) Foreign Application Priority Data

Sep. 22, 2014 (JP) ..... 2014-192313

(51) Int. Cl.
*B41J 2/175* (2006.01)

(52) U.S. Cl.
CPC ..... *B41J 2/17596* (2013.01)

(58) Field of Classification Search
CPC ..... B41J 2/17596; B41J 2/17503; B41J 2/19; B41J 29/38
See application file for complete search history.

(56) References Cited

U.S. PATENT DOCUMENTS 7,845,784 B2 12/2010 Nitta et al.
2015/0085033 A1* 3/2015 Ando ..... B41J 2/17596 347/92

FOREIGN PATENT DOCUMENTS

JP 2008-162262 7/2008

* cited by examiner

*Primary Examiner* — Sarah Al Hashimi
(74) *Attorney, Agent, or Firm* — Greenblum & Bernstein, P.L.C.

(57) ABSTRACT

A controller regulates pressures of a positive pressure space and a negative pressure space and maintains the pressures at setting pressures when ink is circulated in a circulation path, by: driving an air pump to apply the setting pressures to the positive pressure space and the negative pressure space; and after the setting pressures are applied, controlling opening and closing of a positive-pressure-side pressure regulation valve, opening and closing of a negative-pressure-side pressure regulation valve, and driving of the air pump according to the pressures in the positive pressure space and the negative pressure space, and opening the positive-pressure-side pressure regulation valve or the negative-pressure-side pressure regulation valve simultaneously with the driving of the air pump.

2 Claims, 4 Drawing Sheets

| | | NEGATIVE PRESSURE TANK LIQUID LEVEL SENSOR | |
|---|---|---|---|
| | | ON | OFF |
| POSITIVE PRESSURE TANK LIQUID LEVEL SENSOR | ON | INK PUMP: OFF<br>INK SUPPLY VALVE: CLOSED | INK PUMP: OFF<br>INK SUPPLY VALVE: CLOSED |
| | OFF | INK PUMP: ON<br>INK SUPPLY VALVE: CLOSED | INK PUMP: OFF<br>INK SUPPLY VALVE: OPENED |

INK CIRCULATION TYPE INKJET PRINTER

CROSS REFERENCE TO RELATED APPLICATION

This application is based upon and claims the benefit of priority from the prior Japanese Patent Application No. 2014-192313, filed on Sep. 22, 2014, the entire contents of which are incorporated herein by reference.

BACKGROUND

1. Technical Field

The disclosure relates to an ink circulation type inkjet printer.

2. Related Art

Japanese Unexamined Patent Application Publication No. 2008-162262 describes an ink circulation type inkjet printer that performs printing by ejecting ink from an inkjet head while circulating the ink.

The ink circulation type inkjet printer includes an inkjet head, a positive pressure tank disposed upstream of the inkjet head, and a negative pressure tank disposed downstream of the inkjet head. A positive pressure is applied to the positive pressure tank and a negative pressure is applied to the negative pressure tank, thereby causing circulation of ink. The pressures of the positive pressure tank and the negative pressure tank are set so that a nozzle pressure of the inkjet head is appropriate for ejection of ink.

However, during circulation of ink, a variation in the liquid levels of ink of the positive pressure tank and the negative pressure tank causes a variation in the pressures of the positive pressure tank and the negative pressure tank. Consequently, due to a variation in the nozzle pressure, an appropriate pressure may not be achieved.

To address this, there has been proposed a technique in which a variation in the pressures of the positive pressure tank and the negative pressure tank due to a variation in liquid level is reduced by using the positive pressure tank and the negative pressure tank provided with sufficiently increased air capacities, and thereby a variation in the nozzle pressure is suppressed.

Also, a technique is known which uses a pressure regulator including a mechanical damper to suppress a variation in the pressures of the positive pressure tank and the negative pressure tank, and thus suppress the variation in the nozzle pressure.

In some inkjet printers, the positive pressure tank is disposed at a position higher than the inkjet head so that a positive pressure (hydraulic head pressure) is generated by the difference in height. In such an inkjet printer, the positive pressure tank is opened to the atmosphere during circulation of ink. Since the positive pressure tank is opened to the atmosphere, a variation in the pressures of the positive pressure tank is suppressed, and thus the variation in the nozzle pressure may be suppressed

SUMMARY

However, in the case of suppressing a pressure variation by using the positive pressure tank and the negative pressure tank provided with sufficiently increased air capacities, the space in the device may not be reserved and the sufficient air capacities may not be provided, and thus the pressure variation may not be sufficiently suppressed.

In the configuration that uses a pressure regulator including a mechanical damper, the damper needs to have such high rigidity that the damper can resist the setting pressures for the positive pressure tank and the negative pressure tank. If the setting pressures are high, it may be difficult to satisfy the need.

In the configuration in which the positive pressure tank is disposed at a position higher than the inkjet head and is opened to the atmosphere, if a needed hydraulic head pressure is high, a needed difference in height between the positive pressure tank and the inkjet head may not be reserved in the device.

Therefore, with the various technique described above, a variation in the nozzle pressure due to liquid level variation in the ink tank may not be suppressed.

The present disclosure aims to provide an inkjet printer that is capable of suppressing a variation in the nozzle pressure.

An inkjet printer in accordance with some embodiments includes at least one printing unit, a positive pressure space, a negative pressure space, an air pump, a positive-pressure-side pressure regulation path, a negative-pressure-side pressure regulation path, a positive-pressure-side pressure regulation valve, a negative-pressure-side pressure regulation valve, and a controller. The at least one printing unit includes an inkjet head configured to eject ink, a positive pressure tank configured to store the ink to be supplied to the inkjet head, a negative pressure tank configured to receive the ink not consumed by the inkjet head, a circulation path for circulating the ink among the positive pressure tank, the inkjet head, and the negative pressure tank, an ink pump configured to deliver the ink from the negative pressure tank to the positive pressure tank, and an ink supply unit configured to supply the ink to the negative pressure tank. The positive pressure space includes an air layer on an ink liquid level in the positive pressure tank of the at least one printing unit and is under a positive pressure when the ink is circulated in the circulation path. The negative pressure space includes an air layer on an ink liquid level in the negative pressure tank of the at least one printing unit and is under a negative pressure when the ink is circulated in the circulation path. The air pump is configured to deliver air from the negative pressure space to the positive pressure space, thereby applying the positive pressure to the positive pressure space and the negative pressure to the negative pressure space. The positive-pressure-side pressure regulation path is in communication with the positive pressure space. The negative-pressure-side pressure regulation path is in communication with the negative pressure space. The positive-pressure-side pressure regulation valve is configured to open and close the positive-pressure-side pressure regulation path. The negative-pressure-side pressure regulation valve is configured to open and close the negative-pressure-side pressure regulation path. The controller is configured to regulate pressures of the positive pressure space and the negative pressure space and maintain the pressures at setting pressures when the ink is circulated in the circulation path, by: driving the air pump to apply the setting pressures to the positive pressure space and the negative pressure space; and after the setting pressures are applied, controlling opening and closing of the positive-pressure-side pressure regulation valve, opening and closing of the negative-pressure-side pressure regulation valve, and driving of the air pump according to the pressures in the positive pressure space and the negative pressure space, and opening the positive-pressure-side pressure regulation valve or the negative-pressure-side pressure regulation valve simultaneously with the driving of the air pump.

With the configuration described above, it is possible to suppress a pressure variation in the positive pressure space and the negative pressure space, the pressure variation being according to a liquid level variation in the positive pressure tank and the negative pressure tank during circulation of ink. Consequently, it is possible to suppress a variation in the nozzle pressure.

The positive-pressure-side pressure regulation path may have a flow path resistance allowing a flow rate of air through the positive-pressure-side pressure regulation path during the circulation of the ink in the circulation path with the positive-pressure-side pressure regulation valve opened to be less than or equal to a sum of a total flow rate of the ink pump of the at least one printing unit and a flow rate of the air pump. The negative-pressure-side pressure regulation path may have a flow path resistance allowing a flow rate of air through the negative-pressure-side pressure regulation path during the circulation of the ink in the circulation path with the negative-pressure-side pressure regulation valve opened to be less than or equal to the sum of the total flow rate of the ink pump of the at least one printing unit and the flow rate of the air pump.

With the configuration described above, it is possible to suppress excessive increase in the flow rate of the air that flows out from the positive pressure space through the positive-pressure-side pressure regulation path, and thus excessive variation in the pressure of the positive pressure space is suppressed. In addition, it is possible to suppress excessive increase in the flow rate of the air that flows into the negative pressure space through the negative-pressure-side pressure regulation path, and thus excessive variation in the pressure of the negative pressure space is suppressed.

DETAILED DESCRIPTION

Figure 1:
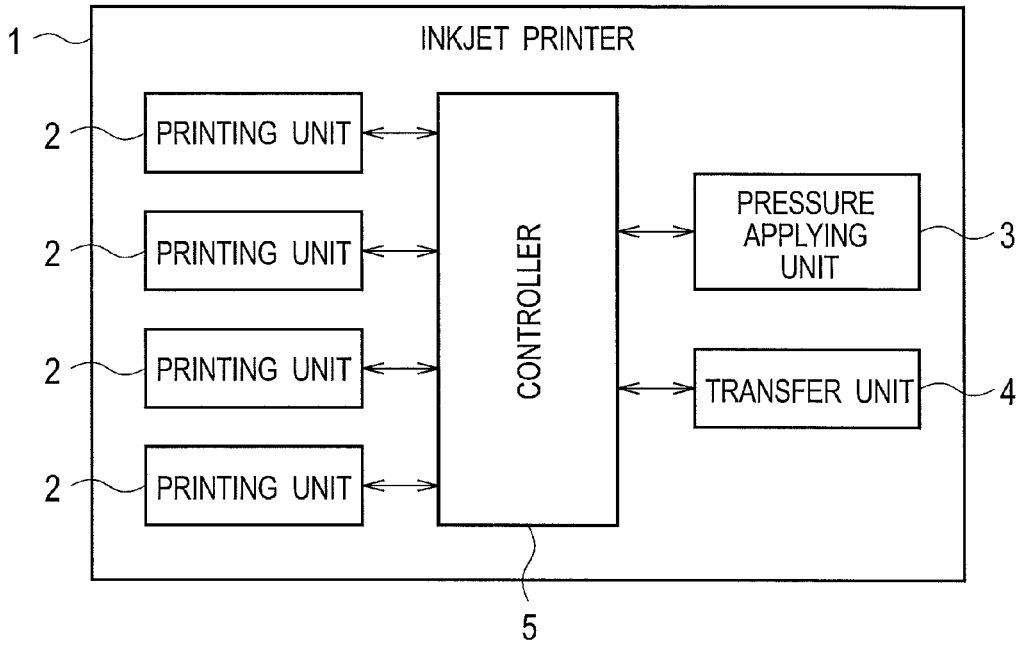
FIG. 1 is a block diagram illustrating a configuration of an inkjet printer according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
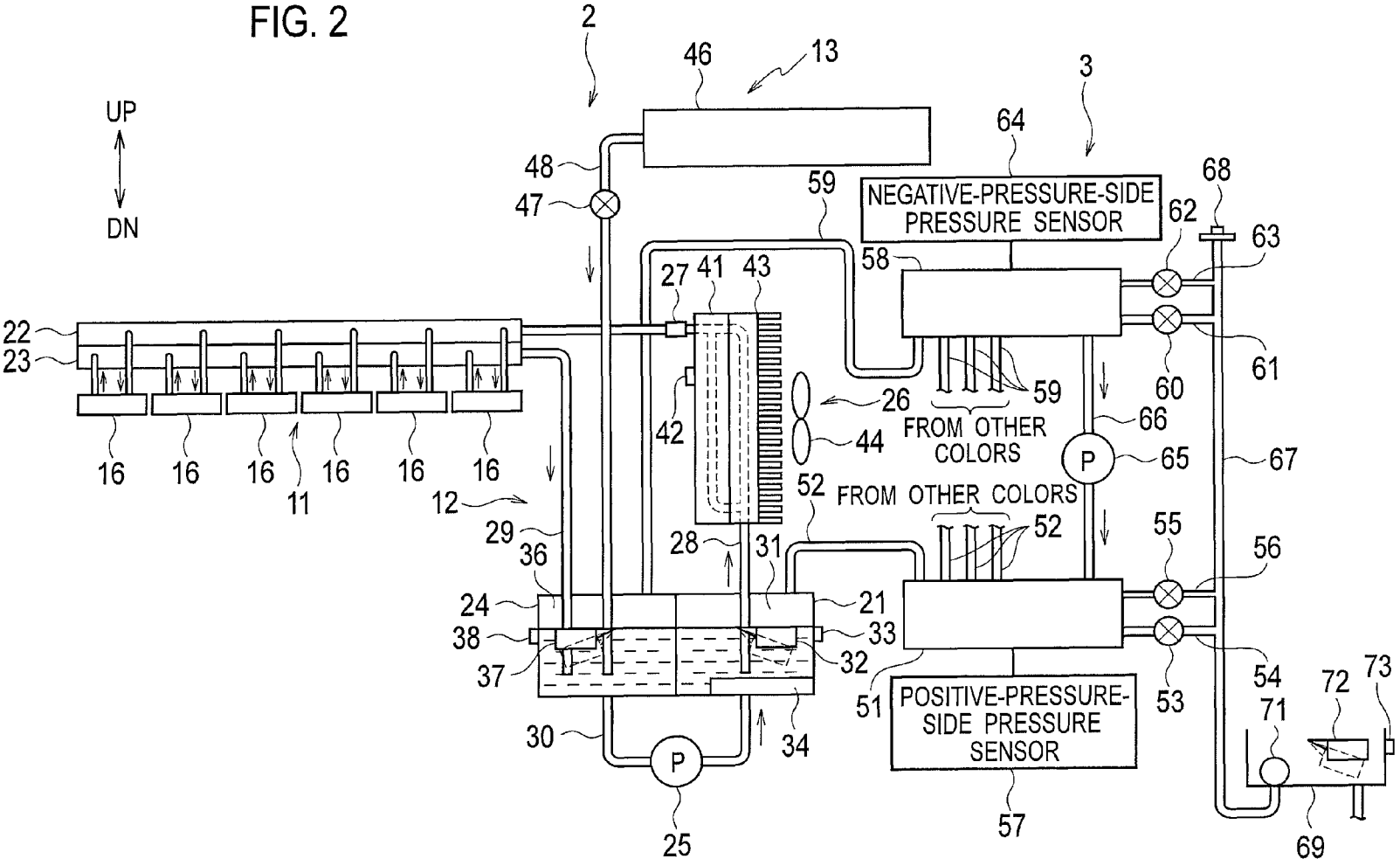
FIG. 2 is a schematic configuration diagram of printing units and a pressure applying unit of the inkjet printer illustrated in FIG. 1.

FIG. 1 is a block diagram illustrating the configuration of an inkjet printer according to an embodiment of the present disclosure. FIG. 2 is a schematic configuration diagram of printing units and a pressure applying unit of the inkjet printer illustrated in FIG. 1. It is to be noted that the upward and downward directions in the following description indicate the vertical direction, and UP indicates the upward direction and DN indicates the downward direction in FIG. 2.

As illustrated in FIG. 1, an inkjet printer 1 according to the present embodiment includes four printing units 2, a pressure applying unit 3, a transfer unit 4, and a controller 5.

Each of the printing units 2 ejects ink onto a sheet of paper to print an image while circulating ink, the sheet of paper being transferred by the transfer unit 4. The four printing units 2 eject ink of different colors (for instance, black, cyan, magenta, yellow). The four printing units 2 have the same configuration except that the colors of ink to be ejected are different.

As illustrated in FIG. 2, each of the printing units 2 includes an inkjet head 11, an ink circulation unit 12 and an ink supply unit 13.

The inkjet head 11 ejects ink which is supplied by the ink circulation unit 12. The inkjet head 11 includes plural head modules 16.

Each of the head modules 16 has an ink chamber (not illustrated) that stores ink and plural nozzles (not illustrated) that eject ink. A piezo element (not illustrated) is disposed in the ink chamber. Ink is ejected through the nozzles by driving of the piezo element.

The ink circulation unit 12 supplies ink to the inkjet head 11 while circulating ink. The ink circulation unit 12 includes a positive pressure tank 21, an ink distributor 22, an ink collector 23, a negative pressure tank 24, an ink pump 25, an ink temperature regulator 26, an ink temperature sensor 27, and ink circulation pipes 28 to 30.

The positive pressure tank 21 stores ink to be supplied to the inkjet head 11. The ink in the positive pressure tank 21 is supplied to the inkjet head 11 via the ink circulation pipe 28 and the ink distributor 22. An air layer 31 is formed on the liquid level of the ink in the positive pressure tank 21. The positive pressure tank 21 communicates with the later-described positive pressure common air chamber 51 via the later-described positive-pressure-side communication pipes 52. The positive pressure tank 21 is disposed at a position lower than (under) the inkjet head 11.

The positive pressure tank 21 is provided with a float member 32, a positive pressure tank liquid level sensor 33, and an ink filter 34.

One end of the float member 32 is pivotally supported by a support axle (not illustrated) in the positive pressure tank 21 so that the float member 32 rotates according to the liquid level height of the ink in the positive pressure tank 21 until the liquid level height reaches a reference height. The other end of the float member 32 is provided with a magnet (not illustrated).

The positive pressure tank liquid level sensor 33 is for determining whether or not the liquid level height of the ink in the positive pressure tank 21 has reached a reference height. The reference height is lower than the upper end of the positive pressure tank 21. The positive pressure tank liquid level sensor 33 includes a magnetic sensor and detects the magnet of the float member 32 when the liquid level height has reached the reference height. When the magnet of the float member 32 is detected, that is, when the liquid level height in the positive pressure tank 21 is greater than or equal to the reference height, the positive pressure tank liquid level sensor 33 outputs a signal that indicates "ON". When the magnet of the float member 32 is not detected, that is, when the liquid level height in the positive pressure tank 21 is less than the reference height, the positive pressure tank liquid level sensor 33 outputs a signal that indicates "OFF".

The ink filter 34 removes dirt and other in the ink.

The ink distributor 22 distributes the ink supplied from the pressure tank 21 to each head module 16 of the inkjet head 11 through the ink circulation pipe 28.

The ink collector 23 collects from each head module 16 the ink that has not been consumed by the inkjet head 11. The ink collected by the ink collector 23 flows to the negative pressure tank 24 through the ink circulation pipe 29.

The negative pressure tank 24 receives from the ink collector 23 and stores the ink that has not been consumed by the inkjet head 11. In addition, the negative pressure tank 24 stores the ink that is supplied from an ink cartridge 46 of the later-described ink supply unit 13. An air layer 36 is formed on the liquid level of the ink in the negative pressure tank 24. The negative pressure tank 24 communicates with the later-described negative pressure common air chamber 58 through the later-described negative-pressure-side communication pipe 59. The negative pressure tank 24 is disposed at the same height as the positive pressure tank 21.

The negative pressure tank 24 is provided with a float member 37 and a negative pressure tank liquid level sensor 38.

The float member 37 and the negative pressure tank liquid level sensor 38 are similar to the float member 32 and the pressure tank liquid level sensor 38 of the positive pressure tank 21. When the magnet of the float member 37 is detected, that is, when the liquid level height in the negative pressure tank 24 is greater than or equal to the reference height, the pressure tank liquid level sensor 38 outputs a signal that indicates "ON". When the magnet of the float member 37 is not detected, that is, when the liquid level height in the negative pressure tank 24 is less than the reference height, the pressure tank liquid level sensor 38 outputs a signal that indicates "OFF". The reference height is lower than the upper end of the negative pressure tank 24.

The ink pump 25 delivers ink from the negative pressure tank 24 to the positive pressure tank 21. The ink pump 25 is provided midway along the ink circulation pipe 30.

The ink temperature regulator 26 regulates the temperature of the ink in the ink circulation unit 12. The ink temperature regulator 26 is provided midway along the ink circulation pipe 28. The ink temperature regulator 26 includes a heater 41, a heater temperature sensor 42, a heat sink 43, and a cooling fan 44.

The heater 41 heats the ink in the ink circulation pipe 28. The heater temperature sensor 42 detects the temperature of the heater 41. The heat sink 43 cools the ink in the ink circulation pipe 28 by heat radiation. The cooling fan 44 delivers cooling air to the heat sink 43.

The ink temperature sensor 27 detects the temperature of the ink in the ink circulation unit 12. The ink temperature sensor 27 is provided midway along the ink circulation pipe 28.

The ink circulation pipe 28 connects the positive pressure tank 21 and the ink distributor 22. Part of the ink circulation pipe 28 is branched into a portion that passes through the heater 41 and a portion that passes through the heat sink 43. In the ink circulation pipe 28, ink flows from the positive pressure tank 21 to the ink distributor 22. The ink circulation pipe 29 connects the ink collector 23 and the negative pressure tank 24. In the ink circulation pipe 29, ink flows from the ink collector 23 to the negative pressure tank 24. The ink circulation pipe 30 connects the negative pressure tank 24 and the positive pressure tank 21. In the ink circulation pipe 30, ink flows from the negative pressure tank 24 to the positive pressure tank 21. The ink circulation pipes 28 to 30, the ink distributor 22, and the ink collector 23 constitute a circulation path for circulating ink between the positive pressure tank 21, the inkjet head 11, and the negative pressure tank 24.

The ink supply unit 13 supplies ink to the ink circulation unit 12. The ink supply unit 13 includes an ink cartridge 46, an ink supply valve 47, and an ink supply pipe 48.

The ink cartridge 46 stores ink to be used in printing by the inkjet head 11. The ink in the ink cartridge 46 is supplied to the negative pressure tank 24 of the ink circulation unit 12 through the ink supply pipe 48.

The ink supply valve 47 opens and closes the flow path of ink in the ink supply pipe 48. When ink is supplied to the negative pressure tank 24, the ink supply valve 47 is opened.

The ink supply pipe 48 connects the ink cartridge 46 and the negative pressure tank 24. In the ink supply pipe 48, ink flows from the ink cartridge 46 to the negative pressure tank 24.

The pressure applying unit 3 applies pressure for ink circulation to the positive pressure tank 21 and the negative pressure tank 24 of each printing unit 2. The pressure applying unit 3 includes a positive pressure common air chamber 51, four positive-pressure-side communication pipes 52, a positive-pressure-side air opening valve 53, a positive-pressure-side air opening pipe 54, a positive-pressure-side pressure regulation valve 55, a positive-pressure-side pressure regulation pipe 56, a positive-pressure-side pressure sensor 57, a negative pressure common air chamber 58, four negative-pressure-side communication pipes 59, a negative-pressure-side air opening valve 60, a negative-pressure-side air opening pipe 61, a negative-pressure-side pressure regulation valve 62, a negative-pressure-side pressure regulation pipe 63, a negative-pressure-side pressure sensor 64, an air pump 65, a pipe 66 for air pump, a junction pipe 67, an air filter 68, and an overflow pan 69.

The positive pressure common air chamber 51 is a chamber for equalizing the pressures of the positive pressure tanks 21 of the printing units 2. The positive pressure common air chamber 51 communicates with the air layers 31 of the positive pressure tanks 21 of the four printing units 2 through the four positive-pressure-side communication pipes 52. Thus, the pressure tanks 21 of the printing units 2 communicate with each other through the positive pressure common air chamber 51 and the positive-pressure-side communication pipes 52.

The positive-pressure-side communication pipes 52 allow the positive pressure common air chamber 51 and the air layer 31 of the positive pressure tank 21 to communicate with each other. Each printing unit 2 is provided with a corresponding one of the four positive-pressure-side communication pipes 52. Each positive-pressure-side communication pipe 52 has one end connected to the positive pressure common air chamber 51 and the other end connected to the air layer 31 of a corresponding positive pressure tank 21.

The positive-pressure-side air opening valve 53 opens and closes the flow path of the air in the positive-pressure-side air opening pipe 54 for switching between a sealed state (sealed state from the atmosphere) and an air open state (open state to the atmosphere) of the positive pressure tank 21 through the positive pressure common air chamber 51. The positive-pressure-side air opening valve 53 is provided midway along the positive-pressure-side air opening pipe 54.

The positive-pressure-side air opening pipe 54 forms a flow path of air for opening the positive pressure tank 21 to the atmosphere through the positive pressure common air chamber 51. The positive-pressure-side air opening pipe 54 has one end connected to the positive pressure common air chamber 51 and the other end connected to the junction pipe 67. The positive-pressure-side air opening pipe 54 is formed of a pipe having such a low flow path resistance that instantaneously after the positive-pressure-side air opening valve 53 is opened in a state where a positive pressure is applied to the positive pressure common air chamber 51 and the positive pressure tank 21, the pressure of the positive pressure common air chamber 51 and the positive pressure tank 21 can return to the atmospheric pressure.

The positive-pressure-side pressure regulation valve 55 opens and closes the flow path of the air in the positive-pressure-side pressure regulation pipe 56 in order to regulate the pressure of the positive pressure common air chamber 51 and the positive pressure tank 21. The positive-pressure-side pressure regulation valve 55 is provided midway along the positive-pressure-side pressure regulation pipe 56.

The positive-pressure-side pressure regulation pipe 56 forms a flow path of air for pressure regulation of the positive pressure common air chamber 51 and the positive pressure tank 21. The positive-pressure-side pressure regulation pipe 56 has one end connected to the positive pressure common air chamber 51 and the other end connected to the junction pipe 67. The positive-pressure-side pressure regulation pipe 56 corresponds to the positive-pressure-side pressure regulation path in the appended claims. The positive-pressure-side pressure regulation pipe 56 is formed of a pipe having a higher flow path resistance than that of the positive-pressure-side air opening pipe 54, the negative-pressure-side air opening pipe 61, and the junction pipe 67. Specifically, the positive-pressure-side pressure regulation pipe 56 is formed of a pipe narrower than the positive-pressure-side air opening pipe 54, the negative-pressure-side air opening pipe 61, and the junction pipe 67.

More specifically, the positive-pressure-side pressure regulation pipe 56 has a flow path resistance such that the flow rate (quantity of flow) of the air in the positive-pressure-side pressure regulation pipe 56 under the later-described pressure maintaining control during ink circulation with the positive-pressure-side pressure regulation valve 55 opened is less than or equal to the sum of the total flow rate Qip of the ink pumps 25 of the printing units 2 and flow rate Qap of the air pump 65.

Here, the flow rate Qip of the ink pump 25 corresponds to the flow rate of the air that moves according to a variation in the liquid level (increase of the liquid level) of the positive pressure tank 21 due to the movement of ink from the negative pressure tank 24 to the positive pressure tank 21, which is caused by driving of the ink pump 25. It is to be noted that the flow rate Qip is equivalent to the flow rate of the air that moves according to a variation in the liquid level (decrease of the liquid level) of the negative pressure tank 24 simultaneously.

The flow rate Qap of the air pump 65 corresponds to the flow rate of the air that moves from the negative pressure common air chamber 58 to the positive pressure common air chamber 51 by driving of the air pump 65. The flow rate Qap of the air pump 65 is a flow rate greater than or equal to the sum of flow rate Qc and flow rate Qs, the flow rate Qc being the flow rate of the air that moves according to a variation in the liquid level (increase of the liquid level) of the negative pressure tank 24 due to the movement of ink from the positive pressure tank 21 to the negative pressure tank 24 through the inkjet head 11, the flow rate Qs being the flow rate of the air that moves according to a variation in the liquid level (increase of the liquid level) of the negative pressure tank 24 due to ink supply from the ink supply unit 13. The purpose of setting the flow rate Qap of the air pump 65 greater than or equal to the sum of the flow rate Qc and the flow rate Qs is to cope with the pressure variation for the case where the liquid level variation due to inflow of ink into the negative pressure tank 24 is at a maximum in pressure regulation by the air pump 65.

It is to be noted that ink is not supplied from the ink supply unit 13 to the positive pressure tank 21. Also, the above-described flow rate Qc is equivalent to the flow rate of the air that moves according to a variation in the liquid level (decrease of the liquid level) of the positive pressure tank 21 due to the movement of ink from the positive pressure tank 21 to the negative pressure tank 24 through the inkjet head 11. Therefore, when the flow rate Qap of the air pump 65 is greater than or equal to the sum of the flow rate Qc and the flow rate Qs, it is possible to cope with the pressure variation for the case where the liquid level variation due to outflow of ink from the positive pressure tank 21 is at a maximum.

The condition that the flow rate of the air in the positive-pressure-side pressure regulation pipe 56 is less than or equal to the sum of the total flow rate Qip of the ink pumps 25 of the printing units 2 and the flow rate Qap of the air pump 65 indicates that the flow rate of the air that flows out through the positive-pressure-side pressure regulation pipe 56 with the positive-pressure-side pressure regulation valve 55 opened is less than or equal to a maximum variation amount of air in the positive pressure common air chamber 51 and the positive pressure tank 21. Consequently, excessive increase in the flow rate of the air that flows out from the positive pressure common air chamber 51 through the positive-pressure-side pressure regulation pipe 56 is suppressed, and thus excessive variation in the pressures of the positive pressure common air chamber 51 and the positive pressure tank 21 is suppressed The positive-pressure-side pressure sensor 57 detects the pressure of the positive pressure common air chamber 51. The pressure of the positive pressure common air chamber 51 is equal to the pressure of the positive pressure tank 21 of each printing unit 2. This is because the positive pressure common air chamber 51 communicates with the air layer 31 in the positive pressure tank 21 of each printing unit 2.

The negative pressure common air chamber 58 is an air chamber for equalizing the pressures of the negative pressure tanks 24 of the printing units 2. The negative pressure common air chamber 58 communicates with the air layers 36 of the negative pressure tanks 24 of the four printing units 2 through the respective four negative-pressure-side communication pipes 59. Thus, the negative pressure tanks 24 of the printing units 2 communicate with each other through the negative pressure common air chamber 58 and the negative-pressure-side communication pipes 59.

The negative-pressure-side communication pipes 59 allow the negative pressure common air chamber 58 and the air layer 36 of each negative pressure tank 24 to communicate with each other. Each printing unit 2 is provided with a corresponding one of the four negative-pressure-side communication pipes 59. Each negative-pressure-side communication pipes 59 has one end connected to the negative pressure common air chamber 58 and the other end connected to the air layer 36 of a corresponding negative pressure tank 24.

The negative-pressure-side air opening valve 60 opens and closes the flow path of the air in the negative-pressure-side air opening pipe 61 for switching between a sealed state and an air opened state of the negative pressure tank 24 through the negative pressure common air chamber 58. The negative-pressure-side air opening valve 60 is provided midway along the negative-pressure-side air opening pipe 61.

The negative-pressure-side air opening pipe 61 forms a flow path of air for opening the negative pressure tank 24 to the atmosphere through the negative pressure common air chamber 58. The negative-pressure-side air opening pipe 61 has one end connected to the negative pressure common air chamber 58 and the other end connected to the junction pipe 67. Similarly to the positive-pressure-side air opening pipe 54, the negative-pressure-side air opening pipe 61 is formed of a pipe having a low flow path resistance.

The negative-pressure-side pressure regulation valve 62 opens and closes the flow path of the air in the negative-pressure-side pressure regulation pipe 63 in order to regulate the pressure of the negative pressure common air chamber 58 and the negative pressure tank 24. The negative-pressure-side pressure regulation valve 62 is provided midway along the negative-pressure-side pressure regulation pipe 63.

The negative-pressure-side pressure regulation pipe 63 forms a flow path of air for pressure regulation of the negative pressure common air chamber 58 and the negative pressure tank 24. The negative-pressure-side pressure regulation pipe 63 has one end connected to the negative pressure common air chamber 58 and the other end connected to the junction pipe 67. The negative-pressure-side pressure regulation pipe 63 corresponds to the negative-pressure-side pressure regulation path in the appended claims. The negative-pressure-side pressure regulation pipe 63 has a flow path resistance in which the flow rate of the air in the negative-pressure-side pressure regulation pipe 63 under the later-described pressure maintaining control during ink circulation with the negative-pressure-side pressure regulation valve 62 opened is less than or equal to the sum of the total flow rate Qip of the ink pumps 25 of the printing units 2 and the flow rate Qap of the air pump 65. Specifically, the negative-pressure-side pressure regulation pipe 63 is formed of the same pipe as the positive-pressure-side pressure regulation pipe 56.

The condition that the flow rate of the air in the negative-pressure-side pressure regulation pipe 63 is less than or equal to the sum of the total flow rate Qip of the ink pumps 25 of the printing units 2 and the flow rate Qap of the air pump 65 indicates that the flow rate of the air that flows from the outside into the negative-pressure-side pressure regulation pipe 63 with the negative-pressure-side pressure regulation valve 62 opened is less than or equal to a maximum variation amount of air in the negative pressure common air chamber 58 and the negative pressure tank 24. Consequently, excessive increase in the flow rate of the air that flows into the negative pressure common air chamber 58 through the negative-pressure-side pressure regulation pipe 63 is suppressed, and thus excessive variation in the pressure of the negative pressure common air chamber 58 and the negative pressure tank 24 is suppressed.

The negative-pressure-side pressure sensor 64 detects the pressure of the negative pressure common air chamber 58. The pressure of the negative pressure common air chamber 58 is equal to the pressure of the negative pressure tank 24 of each printing unit 2. This is because the negative pressure common air chamber 58 communicates with the air layer 36 of the negative pressure tank 24 of each printing unit 2.

The air pump 65 delivers air from the negative pressure common air chamber 58 to the positive pressure common air chamber 51. The air pump 65 is provided midway along the pipe 66 for air pump. A positive pressure is applied to the positive pressure common air chamber 51 by driving of the air pump 65 and a positive pressure is applied to the positive pressure tank 21 through the positive-pressure-side communication pipe 52. The air layer 31 of the positive pressure tank 21 of each printing unit 2, the positive pressure common air chamber 51, and each positive-pressure-side communication pipe 52 constitute the positive pressure space in the appended claims. Also, a negative pressure is applied to the negative pressure common air chamber 58 by driving of the air pump 65 and a negative pressure is applied to the negative pressure tank 24 through the negative-pressure-side communication pipe 59. The air layer 36 of the negative pressure tank 24 of each printing unit 2, the negative pressure common air chamber 58, and each negative-pressure-side communication pipe 59 constitute the negative pressure space in the appended claims.

The pipe 66 for air pump forms a flow path of air that is delivered from the negative pressure common air chamber 58 to the positive pressure common air chamber 51 by the air pump 65. The pipe 66 for air pump has one end connected to the positive pressure common air chamber 51 and the other end connected to the negative pressure common air chamber 58.

The junction pipe 67 has one end connected to the overflow pan 69 and the other end (upper end) communicating with the atmosphere via the air filter 68. At normal time, the end of the junction pipe 67, near the overflow pan 69 is closed by the later-described overflow ball 71. The junction pipe 67 is connected to the positive-pressure-side air opening pipe 54, the positive-pressure-side pressure regulation pipe 56, the negative-pressure-side air opening pipe 61, and the negative-pressure-side pressure regulation pipe 63. Thus, the positive-pressure-side air opening pipe 54, the positive-pressure-side pressure regulation pipe 56, the negative-pressure-side air opening pipe 61, and the negative-pressure-side pressure regulation pipe 63 each communicate with the atmosphere. The junction pipe 67 is formed of a pipe having a low flow path resistance so that instantaneously after the positive-pressure-side air opening valve 53 and the negative-pressure-side air opening valve 60 are opened, the pressures of the positive pressure common air chamber 51 and the negative pressure common air chamber 58 return to the atmospheric pressure.

The air filter 68 protects the junction pipe 67 against intrusion of dirt and other in the air. The air filter 68 is installed at the upper end of the junction pipe 67.

For instance, in the case where ink overflows from the positive pressure tank 21 and the negative pressure tank 24 and further overflows from the positive pressure common air chamber 51 and the negative pressure common air chamber 58 due to abnormality of the ink supply valve 47, the overflow pan 69 receives the overflown ink that flows through the junction pipe 67.

The overflow pan 69 is provided with an overflow ball 71. When there is no ink in the overflow pan 69, the overflow ball 71 closes the open end of the junction pipe 67, in the bottom of the overflow pan 69, thereby protecting the junction pipe 67 against inflow of air from the outside. When ink flows into the overflow pan 69 through the junction pipe 67, the overflow ball 71 floats and allows the ink to flow into the overflow pan 69.

In addition, the overflow pan 69 is provided with a float member 72 and an overflow liquid level sensor 73. The float member 72 and the overflow liquid level sensor 73 are similar to the float member 32 and the positive pressure tank liquid level sensor 33 of the positive pressure tank 21.

The overflow pan 69 is connected to a waste fluid tank (not illustrated), and when the overflow liquid level sensor 73 indicates ON, ink is discharged into the waste fluid tank.

The transfer unit 4 takes a sheet of paper from a paper feed tray (not illustrated) and transfers the sheet along a transfer path. The transfer unit 4 has a roller for transferring a sheet of paper and a motor for driving the roller (both not illustrated).

The controller 5 controls the operation of each component of the inkjet printer 1. The controller 5 includes a storage unit such as a CPU, a RAM, a ROM, and a hard disk. The controller 5 achieves the control (function) described below by executing a desirable program that is stored in the storage unit to be used in the present device.

The controller 5 causes the inkjet head 11 to eject ink and perform printing while circulating ink in the ink circulation unit 12. When ink is circulated, the controller 5 drives the air pump 65 to apply a positive setting pressure Pk to the positive pressure tank 21 and apply a negative setting pressure Pf to the negative pressure tank 24. The setting pressures Pk, Pf are predetermined pressures that allow the nozzle pressure of the inkjet head 11 to stay in an appropriate range of negative pressure while maintaining circulation of the ink at a needed flow rate in the ink circulation unit 12. During ink circulation after the application of the setting pressures Pk, Pf, the controller 5 regulates the pressures of the positive pressure tank 21 and the negative pressure tank 24 to maintain the pressures at the setting pressures Pk, Pf by the later-described pressure maintaining control.

Next, the operation of the inkjet printer 1 will be described.

Figure 3:
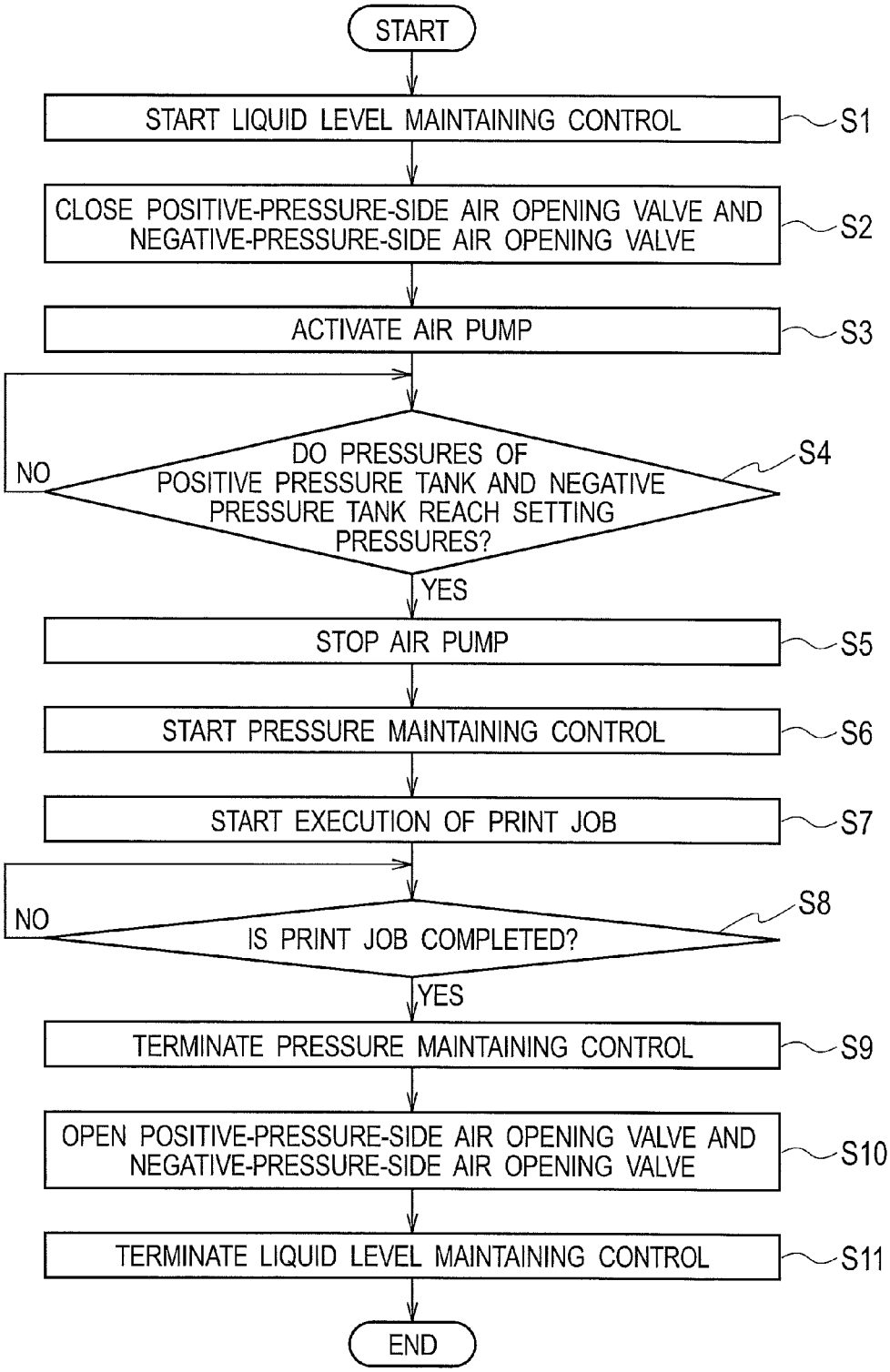
FIG. 3 is a flow chart for explaining the operation of the inkjet printer illustrated in FIG. 1.

FIG. 3 is a flow chart for explaining the operation of the inkjet printer 1. The processing of the flow chart of FIG. 3 starts when a print job is inputted to the inkjet printer 1.

In step S1 of FIG. 3, the controller 5 starts liquid level maintaining control. The liquid level maintaining control is the control of the ink pump 25 and the ink supply valve 47 according to the liquid levels of the positive pressure tank 21 and the negative pressure tank 24 in order to maintain the liquid level at approximately the reference height.

Figures 4, 5:
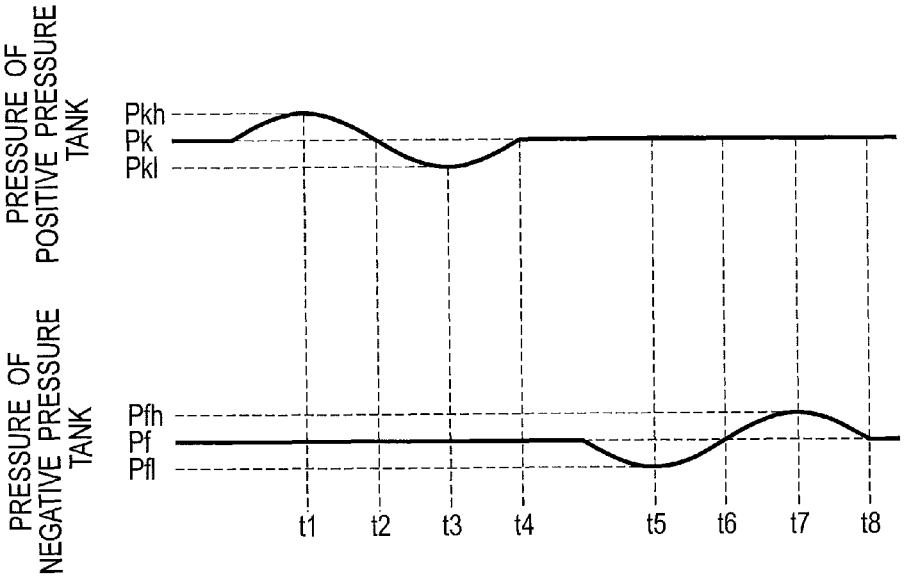
FIG. 4 is an explanatory table for liquid level maintaining control.
FIG. 5 is an explanatory graph for pressure maintaining control.

Specifically, as illustrated in FIG. 4, in a state where both the positive pressure tank liquid level sensor 33 and the negative pressure tank liquid level sensor 38 indicate ON, the controller 5 turns off the ink pump 25 to close the ink supply valve 47. Similarly, in a state where the positive pressure tank liquid level sensor 33 indicates ON and the negative pressure tank liquid level sensor 38 indicates OFF, the controller 5 turns off the ink pump 25 to close the ink supply valve 47.

In a state where the positive pressure tank liquid level sensor 33 indicates OFF and the negative pressure tank liquid level sensor 38 indicates ON, the controller 5 turns on the ink pump 25 to close the ink supply valve 47.

Ina state where both the positive pressure tank liquid level sensor 33 and the negative pressure tank liquid level sensor 38 indicate OFF, the controller 5 turns off the ink pump 25 to open the ink supply valve 47.

Returning to FIG. 3, in step S2 subsequent to step S1, the controller 5 closes the positive-pressure-side air opening valve 53 and the negative-pressure-side air opening valve 60. Thus, the positive pressure tank 21 of each printing unit 2 assumes a sealed state via the positive pressure common air chamber 51, and the negative pressure tank 24 assumes a sealed state via the negative pressure common air chamber 58. It is to be noted that during standby in which the inkjet printer 1 is not in operation, the positive-pressure-side air opening valve 53 and the negative-pressure-side air opening valve 60 are opened, and the positive-pressure-side pressure regulation valve 55 and the negative-pressure-side pressure regulation valve 62 are closed.

Subsequently, in step S3, the controller 5 activates the air pump 65. Thus, the negative pressure common air chamber 58 and the negative pressure tank 24 are decompressed, and the positive pressure common air chamber 51 and the positive pressure tank 21 are pressurized.

Subsequently, in step S4, the controller 5 determines whether or not the pressures of the positive pressure tank 21 and the negative pressure tank 24 have reached respective setting pressures Pk, Pf, based on values detected by the positive-pressure-side pressure sensor 57 and the negative-pressure-side pressure sensor 64. When it is determined that pressures of the positive pressure tank 21 and the negative pressure tank 24 have not reached the respective setting pressure Pk, Pf (NO in step S4), the controller 5 repeats step S4.

Here, in the inkjet printer 1, the capacities of the positive pressure tank 21, the negative pressure tank 24, the positive pressure common air chamber 51, and the negative pressure common air chamber 58 are designed so that the pressures of the positive pressure tank 21 and the negative pressure tank 24 reach the respective setting pressures Pk and Pf simultaneously.

When it is determined that pressures of the positive pressure tank 21 and the negative pressure tank 24 have reached the respective setting pressure Pk, Pf (YES in step S4), the controller 5 stops the air pump 65 in step S5.

In this manner, a positive pressure is applied to the positive pressure tank 21 and a negative pressure is applied to the negative pressure tank 24, thereby causing ink to flow from the positive pressure tank 21 to the negative pressure tank 24 through the inkjet head 11. When the positive pressure tank liquid level sensor 33 indicates OFF and the negative pressure tank liquid level sensor 38 indicates ON, the above-described liquid level maintaining control causes the ink pump 25 to deliver ink from the negative pressure tank 24 to the positive pressure tank 21. In this manner, the ink is circulated.

Subsequently, in step S6, the controller 5 starts pressure maintaining control. The pressure maintaining control is the control of the positive-pressure-side pressure regulation valve 55, the negative-pressure-side pressure regulation valve 62, and the air pump 65 during ink circulation in order to maintain the pressures of the positive pressure tank 21 and the negative pressure tank 24 at respective setting pressures Pk, Pf. The details of the pressure maintaining control will be described later.

Subsequently, in step S7, the controller 5 starts to execute a print job. Specifically, the controller 5 ejects ink from the inkjet head 11 and prints an image on a sheet of paper transferred by the transfer unit 4, based on the print job.

Here, when the inkjet head 11 performs an ejection operation, the inkjet head 11 is heated, thereby causing the temperature of the ink to be increased. For this phenomenon, the controller 5 controls the ink temperature regulator 26 to regulate the ink temperature so that the temperature detected by the ink temperature sensor 27 is maintained in an appropriate temperature range.

After the print job execution is started, in step S8, the controller 5 determines whether or not the print job is completed. When it is determined that the print job is not completed (NO in step S8), the controller 6 repeats step S8.

When it is determined that the print job is completed (YES in step S8), in step S9, the controller 5 terminates the pressure maintaining control.

Subsequently, in step S10, the controller 5 opens the positive-pressure-side air opening valve 53 and the negative-pressure-side air opening valve 60. Thus, the positive pressure tank 21 of each printing unit 2 is opened to the atmosphere via the positive pressure common air chamber 51, and the negative pressure tank 24 is opened to the atmosphere via the negative pressure common air chamber 58.

Subsequently, in step S11, the controller 5 terminates the liquid level maintaining control. Thus, a series of operations is completed and the inkjet printer 1 is set in a standby state.

Next, the pressure maintaining control started in the aforementioned step S6 of FIG. 3 will be described.

As described above, during ink circulation, ink flows from the positive pressure tank 21 to the negative pressure tank 24 through the inkjet head 11. During execution of the print job, the amount of circulating ink is decreased due to ejection of ink from the inkjet head 11. On the other hand, the liquid levels of the positive pressure tank 21 and the negative pressure tank 24 are maintained by the above-described liquid level maintaining control. However, even when the liquid level maintaining control is performed, liquid level variation occurs according to hysteresis of ON and OFF indicated by the positive pressure tank liquid level sensor 33 and the negative pressure tank liquid level sensor 38 in the positive pressure tank 21 and the negative pressure tank 24. The pressure maintaining control is for suppressing a pressure variation in the positive pressure tank 21 and the negative pressure tank 24, the pressure variation being caused by the liquid level variation.

Specifically, after the setting pressures Pk, Pf are set, when the pressure of the positive pressure tank 21 detected by the positive-pressure-side pressure sensor 57 is increased up to positive-pressure-side upper limit Pkh, the controller 5 opens the positive-pressure-side pressure regulation valve 55. The positive-pressure-side upper limit Pkh is a value that is higher than the setting pressure Pk by a predetermined value. The opening of the positive-pressure-side pressure regulation valve 55 causes the pressure of the positive pressure common air chamber 51 and the positive pressure tank 21 to decrease.

On the other hand, when the pressure of the positive pressure tank 21 is decreased down to positive-pressure-side lower limit Pkl, the controller 5 drives the air pump 65. Simultaneously with this, the controller 5 opens the negative-pressure-side pressure regulation valve 62. The positive-pressure-side lower limit Pkl is a value that is lower than the setting pressure Pk by a predetermined value. The driving of the air pump 65 causes the pressure of the positive pressure tank 21 to increase. The opening of the negative-pressure-side pressure regulation valve 62 suppresses a pressure decrease in the negative pressure common air chamber 58 and the negative pressure tank 24, the pressure decrease being caused by the drive of the air pump 65.

When the pressure of the negative pressure tank 24 is decreased down to negative-pressure-side lower limit Pfl, the controller 5 opens the negative-pressure-side pressure regulation valve 62. The negative-pressure-side lower limit Pfl is a value that is lower than the setting pressure Pf by a predetermined value. The opening of the negative-pressure-side pressure regulation valve 62 causes the pressure of the negative pressure common air chamber 58 and the negative pressure tank 24 to increase.

When the pressure of the negative pressure tank 24 is increased up to negative-pressure-side upper limit Pfh, the controller 5 drives the air pump 65. Simultaneously with this, the controller 5 opens the positive-pressure-side pressure regulation valve 55. The negative-pressure-side upper limit Pfh is a value that is higher than the setting pressure Pf by a predetermined value. The driving of the air pump 65 causes the pressure of the negative pressure tank 24 to decrease. The opening of the positive-pressure-side pressure regulation valve 55 suppresses a pressure increase in the positive pressure common air chamber 51 and the positive pressure tank 21, the pressure increase being caused by the drive of the air pump 65.

In this manner, opening and closing of the positive-pressure-side pressure regulation valve 55, opening and closing of the negative-pressure-side pressure regulation valve 62, and driving of the air pump 65 are controlled according to the pressures of the positive pressure tank 21 and the negative pressure tank 24, thereby suppressing a pressure variation in the positive pressure tank 21 and the negative pressure tank 24.

For instance, when the pressure of the positive pressure tank 21 is increased up to the positive-pressure-side upper limit Pkh at time t1 of FIG. 5, the controller 5 opens the positive-pressure-side pressure regulation valve 55. Consequently, air flows to the outside from the positive pressure common air chamber 51 through the positive-pressure-side pressure regulation pipe 56, thereby decreasing the pressure of the positive pressure common air chamber 51 and the positive pressure tank 21. When the pressure of the positive pressure tank 21 is decreased down to the setting pressure Pk at time t2, the controller 5 closes the positive-pressure-side pressure regulation valve 55.

When the pressure of the positive pressure tank 21 is decreased down to the positive-pressure-side lower limit Pkl at time t3, the controller 5 starts the air pump 65. In addition, the controller 5 opens the negative-pressure-side pressure regulation valve 62 simultaneously with the start of the air pump 65. The driving of the air pump 65 causes air to flow into the positive pressure common air chamber 51, thereby increasing the pressure of the positive pressure common air chamber 51 and the positive pressure tank 21. At this point, the driving of the air pump 65 causes air to be sucked from the negative pressure common air chamber 58. However, air flows in through the negative-pressure-side pressure regulation pipe 63, thereby suppressing a pressure decrease in the negative pressure common air chamber 58 and the negative pressure tank 24. When the pressure of the positive pressure tank 21 is increased up to the setting pressure Pk at time t4, the controller 5 stops the air pump 65 and closes the negative-pressure-side pressure regulation valve 62.

When the pressure of the negative pressure tank 24 is decreased down to the negative-pressure-side lower limit Pfl at time t5, the controller 5 opens the negative-pressure-side pressure regulation valve 62. Consequently, air flows from the outside into the negative pressure common air chamber 58 through the negative-pressure-side pressure regulation pipe 63, thereby increasing the pressure of the negative pressure common air chamber 58 and the negative pressure tank 24. When the pressure of the negative pressure tank 24 is increased up to the setting pressure Pf at time t6, the controller 5 closes the negative-pressure-side pressure regulation valve 62.

When the pressure of the negative pressure tank 24 is increased up to the negative-pressure-side upper limit Pfh at time t7, the controller 5 starts the air pump 65. Also, the controller 5 opens the positive-pressure-side pressure regulation valve 55 simultaneously with the start of the air pump 65. The driving of the air pump 65 causes air to flow out from the negative pressure common air chamber 58, thereby decreasing the pressure of the negative pressure common air chamber 58 and the negative pressure tank 24. At this point, the driving of the air pump 65 causes air to flow into the positive pressure common air chamber 51. However, air flows to the outside from the positive pressure common air chamber 51 through the positive-pressure-side pressure regulation pipe 56, thereby suppressing a pressure increase in the positive pressure common air chamber 51 and the positive pressure tank 21. When the pressure of the negative pressure tank 24 is decreased down to the setting pressure Pf at time t8, the controller 5 stops the air pump 65 and closes the positive-pressure-side pressure regulation valve 55.

As described above, in the inkjet printer 1, the controller 5 applies the setting pressures Pk, Pf to the positive pressure tank 21 and the negative pressure tank 24, then performs pressure maintaining control. Specifically, the controller 5 controls opening and closing of the positive-pressure-side pressure regulation valve 55, opening and closing of the negative-pressure-side pressure regulation valve 62, and driving of the air pump 65 according to the pressures of the positive pressure tank 21 and the negative pressure tank 24, and simultaneously with the drive of the air pump 65, the controller 5 opens the positive-pressure-side pressure regulation valve 55 or the negative-pressure-side pressure regulation valve 62, thereby regulating the pressures of the positive pressure tank 21 and the negative pressure tank 24 to maintain the pressures at the setting pressures Pk, Pf.

Thereby, the inkjet printer 1 is capable of suppressing a pressure variation according to a liquid level variation in the positive pressure tank 21 and the negative pressure tank 24 during ink circulation. Consequently, the variation in the nozzle pressure is capable of suppressing.

In addition, in the inkjet printer 1, the positive-pressure-side pressure regulation pipe 56 and the negative-pressure-side pressure regulation pipe 63 each have a flow path resistance such that the flow rate under the pressure maintaining control during ink circulation with the positive-pressure-side pressure regulation valve 55 and the negative-pressure-side pressure regulation valve 62 opened is less than or equal to the sum of the total flow rate Qip of the ink pumps 25 of the printing units 2 and the flow rate Qap of the air pump 65. Consequently, excessive increase in the flow rate of the air that flows out from the positive pressure common air chamber 51 through the positive-pressure-side pressure regulation pipe 56 in the pressure maintaining control is suppressed, and thus excessive variation in the pressure of the positive pressure tank 21 is suppressed. In addition, excessive increase in the flow rate of the air that flows into the negative pressure common air chamber 58 through the negative-pressure-side pressure regulation pipe 63 is suppressed, and thus excessive variation in the pressure of the negative pressure tank 24 is suppressed.

In the aforementioned embodiment, the inkjet printer 1 having four printing units 2 has been described. However, the number of printing units 2 is not limited to four and at least one printing unit 2 may be provided.

When a configuration is adopted in which one printing unit 2 is provided, the positive-pressure-side air opening pipe 54 and the positive-pressure-side pressure regulation pipe 56 may be connected to the air layer 31 of the positive pressure tank 21, the negative-pressure-side air opening pipe 61 and the negative-pressure-side pressure regulation pipe 63 may be connected to the air layer 36 of the negative pressure tank 24, one end of the pipe 66 for air pump may be connected to the air layer 31 of the positive pressure tank 21, and the other end may be connected to the air layer 36 of the negative pressure tank 24. In this case, the air layer 31 of the positive pressure tank 21 corresponds to the positive pressure space in the appended claims, and the air layer 36 of the negative pressure tank 24 corresponds to the negative pressure space in the appended claims.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

at least one printing unit including an inkjet head configured to eject ink, a positive pressure tank configured to store the ink to be supplied to the inkjet head, a negative pressure tank configured to receive the ink not consumed by the inkjet head, a circulation path for circulating the ink among the positive pressure tank, the inkjet head, and the negative pressure tank, an ink pump configured to deliver the ink from the negative pressure tank to the positive pressure tank, and an ink supply unit configured to supply the ink to the negative pressure tank;

a positive pressure space including an air layer on an ink liquid level in the positive pressure tank of the at least one printing unit and being under a positive pressure when the ink is circulated in the circulation path;

a negative pressure space including an air layer on an ink liquid level in the negative pressure tank of the at least one printing unit and being under a negative pressure when the ink is circulated in the circulation path;

an air pump configured to deliver air from the negative pressure space to the positive pressure space, thereby applying the positive pressure to the positive pressure space and the negative pressure to the negative pressure space;

a positive-pressure-side pressure regulation path in communication with the positive pressure space;

a negative-pressure-side pressure regulation path in communication with the negative pressure space;

a positive-pressure-side pressure regulation valve configured to open and close the positive-pressure-side pressure regulation path;

a negative-pressure-side pressure regulation valve configured to open and close the negative-pressure-side pressure regulation path; and a controller configured to regulate pressures of the positive pressure space and the negative pressure space and maintain the pressures at setting pressures when the ink is circulated in the circulation path, by:

driving the air pump to apply the setting pressures to the positive pressure space and the negative pressure space; and after the setting pressures are applied, controlling opening and closing of the positive-pressure-side pressure regulation valve, opening and closing of the negative-pressure-side pressure regulation valve, and driving of the air pump according to the pressures in the positive pressure space and the negative pressure space, and opening the positive-pressure-side pressure regulation valve or the negative-pressure-side pressure regulation valve simultaneously with the driving of the air pump.

2. The inkjet printer according to claim 1, wherein the positive-pressure-side pressure regulation path has a flow path resistance allowing a flow rate of air through the positive-pressure-side pressure regulation path during the circulation of the ink in the circulation path with the positive-pressure-side pressure regulation valve opened to be less than or equal to a sum of a total flow rate of the ink pump of the at least one printing unit and a flow rate of the air pump, and the negative-pressure-side pressure regulation path has a flow path resistance allowing a flow rate of air through the negative-pressure-side pressure regulation path during the circulation of the ink in the circulation path with the negative-pressure-side pressure regulation valve opened to be less than or equal to the sum of the total flow rate of the ink pump of the at least one printing unit and the flow rate of the air pump.

* * * * *